US012055081B2

(12) United States Patent
Hoye et al.

(10) Patent No.: US 12,055,081 B2
(45) Date of Patent: Aug. 6, 2024

(54) DUAL-WALL INTEGRATED FLANGE JOINT

(71) Applicant: Cummins Inc., Columbus, IN (US)

(72) Inventors: Robert F. Hoye, Columbus, IN (US); Victor Matthew Penrod, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 31 days.

(21) Appl. No.: 17/054,577

(22) PCT Filed: May 15, 2019

(86) PCT No.: PCT/US2019/032348
§ 371 (c)(1),
(2) Date: Nov. 11, 2020

(87) PCT Pub. No.: WO2019/222306
PCT Pub. Date: Nov. 21, 2019

(65) Prior Publication Data

US 2021/0087963 A1 Mar. 25, 2021

Related U.S. Application Data

(60) Provisional application No. 62/671,796, filed on May 15, 2018.

(51) Int. Cl.
*F01N 13/10* (2010.01)
*F01N 13/18* (2010.01)

(52) U.S. Cl.
CPC ..... *F01N 13/102* (2013.01); *F01N 13/107* (2013.01); *F01N 13/1844* (2013.01); *F01N 2450/22* (2013.01); *F01N 2450/24* (2013.01)

(58) Field of Classification Search
CPC .. F01N 13/102; F01N 13/107; F01N 13/1844; F01N 2450/22; F01N 2450/24
(Continued)

(56) References Cited

U.S. PATENT DOCUMENTS 4,833,882 A 5/1989 Yasuda et al.
4,884,400 A * 12/1989 Tanaka ..... F01N 13/18 60/323
(Continued)

FOREIGN PATENT DOCUMENTS

CN 1462333 A 12/2003
CN 1483601 A 3/2004
(Continued)

OTHER PUBLICATIONS

International Search Report and Written Opinion issued by the ISA/US, Commissioner for Patents, dated Nov. 1, 2019, for International Application No. PCT/US2019/032348; 6 pages.
(Continued)

*Primary Examiner* — Lessanework Seifu
(74) *Attorney, Agent, or Firm* — Faegre Drinker Biddle & Reath LLP

(57) ABSTRACT

A dual-wall integrated flange joint is provided. The integrated flange joint includes an inner wall having at least one inlet and at least one outlet, a flange extending radially outward from the inlet of the inner wall, and a collar extending from the flange in the direction of the inner wall and surrounding at least a portion of the inner wall. The integrated flange joint is formed of a single piece of material. Also, the collar at least partially defines an outer wall, and a volume between the collar and the inner wall at least partially defines an airgap.

18 Claims, 12 Drawing Sheets

(58) Field of Classification Search
USPC ..... 60/322, 323
See application file for complete search history.

(56) References Cited

U.S. PATENT DOCUMENTS

| | | | | |
|---|---|---|---|---|
| 5,349,817 | A | 9/1994 | Bekkering | |
| 6,254,142 | B1 | 7/2001 | Kaifel et al. | |
| 6,427,440 | B1 * | 8/2002 | Bonny | F01N 13/102 60/322 |
| 8,230,680 | B2 | 7/2012 | Riekers et al. | |
| 8,429,906 | B2 | 4/2013 | Rippert | |
| 8,656,709 | B2 | 2/2014 | Phillips et al. | |
| 8,850,805 | B2 | 10/2014 | Riekers et al. | |
| 9,581,065 | B2 | 2/2017 | Yang | |
| 9,719,402 | B2 | 8/2017 | Wade et al. | |
| 9,797,291 | B2 | 10/2017 | Eadie et al. | |
| 2005/0268602 | A1 | 12/2005 | Smatloch et al. | |
| 2006/0067860 | A1 | 3/2006 | Faircloth et al. | |
| 2009/0188247 | A1 | 7/2009 | Phillips, Jr. et al. | |
| 2010/0230953 | A1 * | 9/2010 | Baylot | F16L 59/14 219/137 R |
| 2014/0165544 | A1 | 6/2014 | Geminn | |
| 2015/0123396 | A1 | 5/2015 | Browning | |
| 2015/0218986 | A1 * | 8/2015 | Conyers | F01N 13/18 60/321 |
| 2015/0267597 | A1 | 9/2015 | Fischer et al. | |
| 2015/0267599 | A1 * | 9/2015 | Wegener | F01N 13/107 60/322 |
| 2015/0300235 | A1 * | 10/2015 | Wegener | F01N 13/1811 60/323 |
| 2016/0090890 | A1 | 3/2016 | Fischer et al. | |
| 2016/0115853 | A1 | 4/2016 | Yang | |
| 2016/0177806 | A1 | 6/2016 | McHenry et al. | |
| 2017/0211528 | A1 | 7/2017 | Nola | |
| 2017/0336007 | A1 * | 11/2017 | Rappitsch | B64D 37/005 |
| 2018/0066781 | A1 | 3/2018 | Sanchez | |
| 2020/0080464 | A1 * | 3/2020 | Mahira | F01N 3/20 |

FOREIGN PATENT DOCUMENTS

| | | | |
|---|---|---|---|
| CN | 2636864 | Y | 9/2004 |
| CN | 101175908 | A | 5/2008 |
| CN | 104234877 | A | 12/2014 |
| CN | 104350253 | A | 2/2015 |
| CN | 104832724 | A | 8/2015 |
| CN | 105041439 | A | 11/2015 |
| CN | 105090635 | A | 11/2015 |
| CN | 106545399 | A | 3/2017 |
| CN | 106764160 | A | 5/2017 |
| CN | 107429863 | A | 12/2017 |
| DE | 2935925 | A1 | 3/1981 |
| DE | 102004024831 | A1 | 12/2005 |
| EP | 0232953 | A1 | 8/1987 |
| EP | 3051198 | A1 | 8/2016 |
| GB | 2122683 | A | 1/1984 |
| GB | 2309491 | A | 7/1997 |
| JP | H09242537 | A1 | 9/1997 |
| JP | 10-266849 | A | 10/1998 |
| JP | 2007-247450 | A | 9/2007 |
| KR | 10-2005-0032148 | A | 4/2005 |
| KR | 20120032724 | A | 4/2012 |

OTHER PUBLICATIONS

International Preliminary Report on Patentability received for PCT Patent Application No. PCT/US2019/032348, mailed on Nov. 26, 2020, 6 pages.

Chinese Office Action for Chinese Patent Application No. 2022060602022570, mailed Jun. 9, 2022.

* cited by examiner

DUAL-WALL INTEGRATED FLANGE JOINT

RELATED APPLICATION

This application is a national phase filing of International Application No. PCT/US2019/032348, filed May 15, 2019, which claims the benefit of U.S. Provisional Application No. 62/671,796, filed May 15, 2018, the disclosures of which being expressly incorporated herein by reference.

GOVERNMENT SUPPORT CLAUSE

This invention was made with Government support under DE-EE0007761 awarded by Department of Energy. The Government has certain rights in this invention.

FIELD OF THE DISCLOSURE

This disclosure relates generally to flanged joints, and more specifically to integrated flange joints for joining together two or more components in a mechanical system.

BACKGROUND OF THE DISCLOSURE

Flanged joints are widely known and used in various applications where two or more components are attached together. For example, flanged joints are used in exhaust manifolds in the exhaust system of motor vehicles. Generally, an exhaust manifold attaches to an engine of a motor vehicle at the cylinder head such that the exhaust manifold combines exhaust gases from multiple cylinders and sends those gases to the exhaust systems or a turbocharger. The exhaust manifold is subjected to extreme temperatures reaching hundreds of degrees centigrade in operation. Such high temperatures carry valuable thermal energy, but also lead to significant thermal expansion and stress on the flanged joints. Considerable stress over numerous cycles may result in thermal mechanical fatigue or cracks in the joint through which exhaust gases can escape.

In order to reduce the amount of crack damages caused by thermal stress at the exhaust manifold flanges, some prior-art joints incorporate convolutions or bearings to allow thermal expansion, collars, single wall castings, single wall stampings that move the welded joint away from the high stress areas, or thicker walls made of plate steel or other sheet metals. However, such flanged joints have shortcomings; for example, thick walls increasing the weight of the component and act as a thermal sink, absorbing energy that may be used by the turbocharger or exhaust system, and other prior-art joints have added complexity and cost with additional parts. As an example, a prior-art dual-wall flange joint 1 as illustrated in FIG. 1 incorporates an inner wall 2 and an outer wall 3 together with a flange 4. The inner wall 2, the outer wall 3, and the flange 4 are positioned such that the inner wall 2 is inserted into a bore 5 of the flange 4 through a slip fit connection. Then, the outer wall 3 is disposed in an angular position with respect to both the inner wall 2 and the flange 4, with a space 6 provided between an end portion 8 of the outer wall 3 and the inner wall 2, and another space 7 provided between the end portion 8 and the flange 4. The spaces 6 and 7 allow a weld 9 to extend therebetween, causing the inner wall 2, outer wall 3, and the flange 4 to be welded together. As a result, airgap 10 forms between the inner wall 2 and the outer wall 3 to prevent the walls from acting as the thermal sink. However, this example has disadvantages in that the inner wall, outer wall, and flange are all welded at a single location where these components come into contact with each other, located on the exterior corners formed by intersecting the inner wall and the flange. The location of the weld causes the joint to be highly susceptible to the thermal mechanical fatigue or cracks which can occur after extended use. Also, having numerous separate components in manufacturing the dual-wall flange joint increases the chance of problems occurring during the assembly, such as when either too much heat or not enough heat is applied to the components, thereby resulting in an insufficient weld. Therefore, there is a need to provide a flanged joint to be used in, for example, an exhaust manifold, which enables higher tolerance to thermal stresses that will achieve longer fatigue life, while also increasing the thermal efficiency of the engine by containing more thermal energy in the exhaust gases when compared to the prior-art structures.

SUMMARY OF THE DISCLOSURE

Various embodiments of the present disclosure relate to a dual-wall integrated flange joint used in, for example, a dual-wall exhaust manifold. In one embodiment, the dual-wall integrated flange joint is formed of a single piece of material and includes an inner wall having at least one inlet and at least one outlet, a flange extending radially outward from the inlet of the inner wall, and a collar extending from the flange in the direction of the inner wall and surrounding at least a portion of the inner wall. The collar at least partially defines an outer wall, and a volume between the collar and the inner wall at least partially defines an airgap. Also, the collar allows an outer shell to be welded to the collar to form a weld, such that the weld is located away from a high stress area of the dual-wall integrated flange joint, and the outer wall is at least partially defined by the outer shell and the collar. The collar extends perpendicularly from the flange or in a direction substantially parallel to the inner wall. In some embodiments, at least one of the inlet and the outlet comprises a plurality of openings. According to certain implementations, the inner wall allows an inner runner to be welded to the outlet of the inner wall, and the inner wall is slip fit into the inner runner.

Further embodiments of the present disclosure relate to a dual-wall exhaust manifold with a plurality of dual-wall integrated flange joints and an outer shell. Each of the integrated flange joints is formed of a single piece of material and includes an inner wall having at least one inlet and at least one outlet, a flange extending radially outward from the inlet of the inner wall, and a collar extending from the flange in the direction of the inner wall and surrounding at least a portion of the inner wall. The outer shell is welded to the collars of the plurality of dual-wall integrated flange joints to form a plurality of welds such that the welds are located away from high stress areas of the dual-wall integrated flange joints and a volume between the outer shell and the inner walls at least partially defines an airgap. According to certain implementations, an inner runner is welded to the outlet of the inner wall in each of the dual-wall integrated flange joints, such that the inner runner at least partially defines the volume which defines the airgap. The airgap forms an airtight insulation inside the exhaust manifold. In some embodiments, the outer shell is made of a top shell and a bottom shell, such that the top and bottom shells are welded together to form the outer shell.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

The embodiments will be more readily understood in view of the following description when accompanied by the below figures and wherein like reference numerals represent like elements. These depicted embodiments are to be understood as illustrative of the disclosure and not as limiting in any way.

Figure 1:
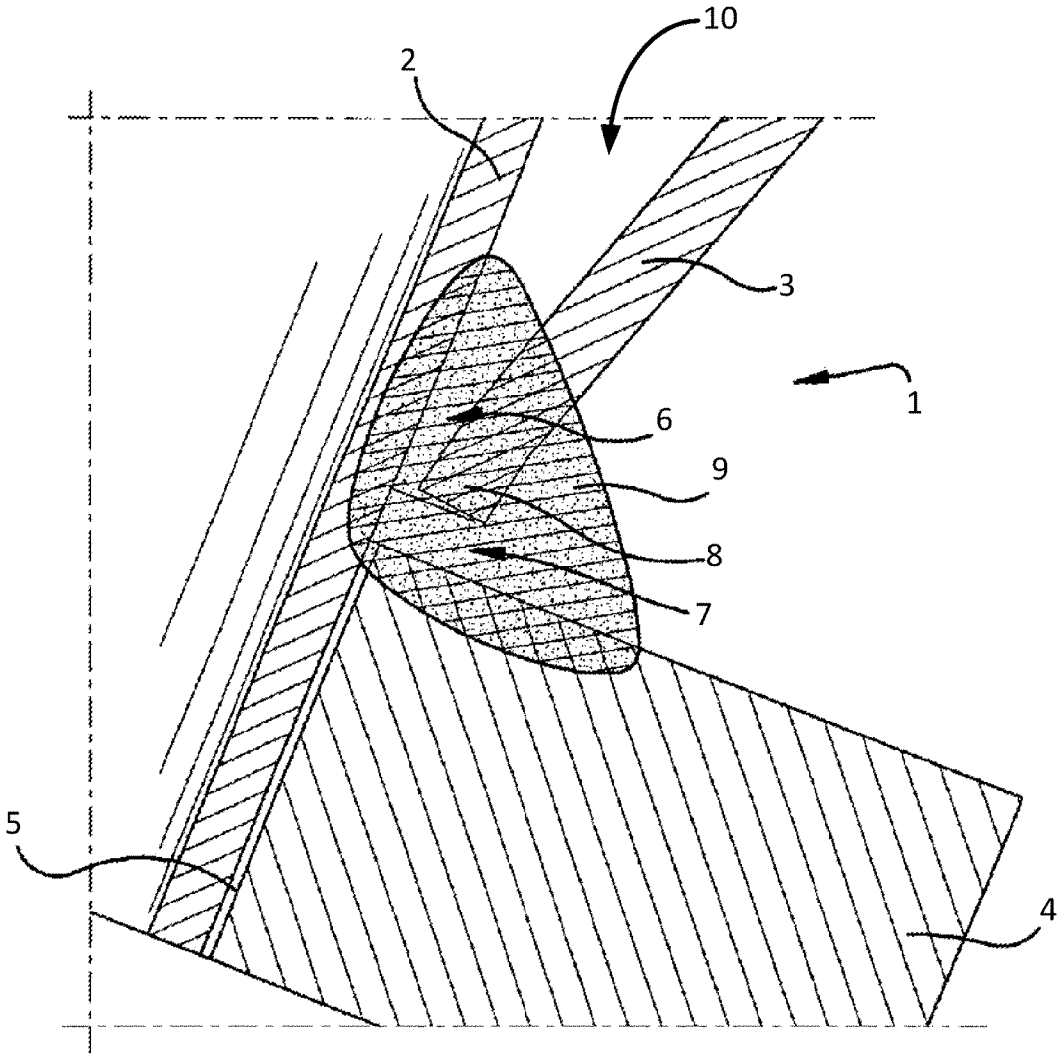
FIG. 1 (prior art)
FIG. 1 is a cross-sectional view of one example of a prior-art dual-wall flange joint.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF THE DISCLOSURE

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments. Furthermore, the described features, structures, or characteristics of the subject matter described herein may be combined in any suitable manner in one or more embodiments.

Figure 2:
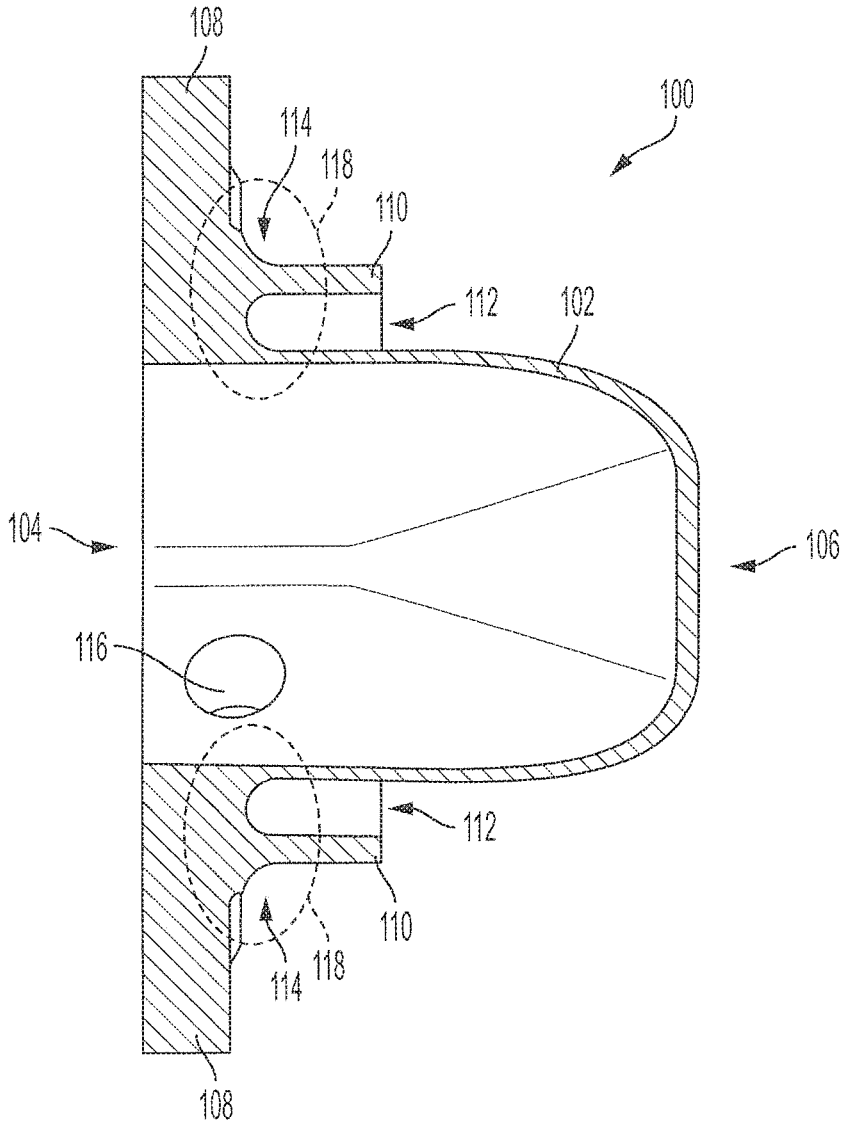
FIG. 2 is a cross-sectional and partial view of one example of a dual-wall integrated flange joint as disclosed herein.

FIG. 2 illustrates an example of a dual-wall integrated flange joint 100 as disclosed herein. The integrated flange joint 100 is formed of a single piece of material and includes an inner wall 102 having an inlet 104 and an outlet 106. The inner wall 102 expands and contracts with different temperature fluxes as fluids such as liquid or gas pass through. The inlet 104 and the outlet 106 have cross sections of various shapes as appropriate for implementing the integrated flange joint 100, such as a circle, oval, or other configurations defined by a plurality of lines and curves. A flange 108 extends radially outward from the portion of the inner wall 102 which defines the inlet 104, with a thickness sufficient to support the integrated flange joint 100. A collar 110 extends from the surface of the flange 108 in the direction of the inner wall 102 such that the collar 110 surrounds the outer surface of the inner wall 102, forming an enclosure around at least a portion of the inner wall 102. The space, or volume, formed between the collar 110 and the inner wall 102 partially defines an airgap 112. Curvatures called fillets 114 are formed on the exterior corners around the inner wall 102 and the collar 110 to distribute stress over a broader area in order to increase durability of the integrated flange joint 100 which would otherwise be concentrated to a welded joint.

In certain implementations, the collar 110 either extends outward away from the inner wall 102, inward toward the inner wall 102, or substantially parallel to the inner wall 102. Also, in other implementations, the collar 110 extends substantially perpendicularly with respect to the flange 108, independently of the shape and orientation of the inner wall 102. In one example, the collar 110 surrounds the inner wall 102 such that there is a constant distance between the inner surface of the collar 110 and the outer surface of the inner wall 102, while in another example, some areas of the collar 110 are closer to or farther from the inner wall 102 than other areas. The length and thickness of the collar 110 are adjustable to match the dimensions of an outer shell which is to be welded to the collar 110, as appropriate.

Also, in certain implementations, the inner wall 102 includes one or more openings 116 which couple with sensors for measuring temperature and pressure, for example, inside the inner wall 102. Examples of such sensors are thermocouples connected to the inlets 104 which enable measurement of temperature within the inlets 104, and exhaust manifold pressure (EMP) sensors which measure the pressure of exhaust gas passing through the inlets 104. Other suitable sensors may be implemented, as appropriate. The integrated flange joint 100 is manufactured using various techniques including but not limited to 3D printing, metal injection molding, and other suitable metalworking processes that are well known in the arts. In one implementation using for example 3D printing to manufacture the integrated flange joint 100, the single piece of material forming the integrated flange joint 100 is Inconel, such as Inconel 718, although other suitable metal alloys and superalloys can be used as appropriate. Also, techniques such as abrasive flow machining (AFM), or fluid honing, smoothen the inner surface of the integrated flange joint and improve the surface finish thereof.

Figure 3:
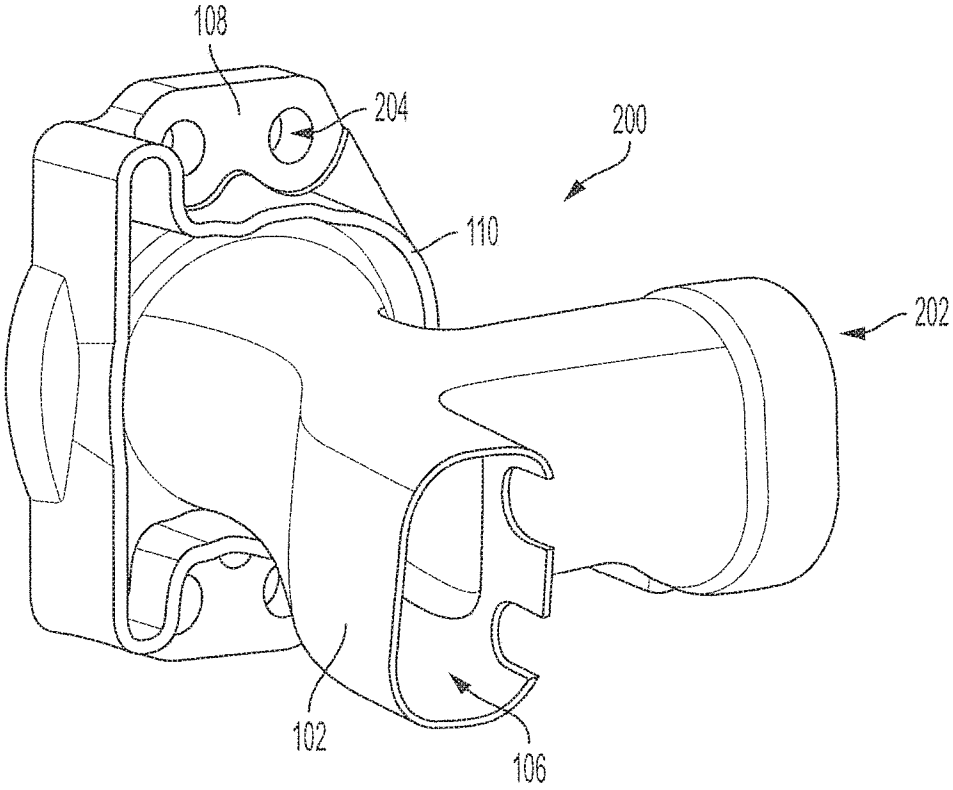
FIG. 3 is a diagonal view of one example of a dual-wall integrated flange joint as disclosed herein.

FIG. 3 illustrates an example of another dual-wall integrated flange joint 200 as disclosed herein. Extending from the flange 108, the collar 110 surrounds the periphery of a portion of the inner wall 102 which includes a second outlet 202 in addition to the first outlet 106. The second outlet 202 is connectable to another integrated flange joint, or other components as appropriate. The integrated flange joint 200 also includes a plurality of openings 204 for inserting fastener components such as bolts used to secure the integrated flange joint 200 to the machine coupled therewith.

Prior-art examples as shown in FIG. 1 require that each component of the dual-wall flange (i.e. the inner wall, the outer wall, and the flange) is made separately and assembled together using methods such as welding. On the other hand, the dual-wall integrated flange joints in the present disclosure are formed with a single piece of material, for example using 3D printing techniques, which do not require the inner and outer walls to be welded to the flange at a location that causes the joint to be susceptible to thermal mechanical fatigue. Advantages of having a single piece of material form the dual-wall integrated flange joint include the ability to locate the point of welding, hereinafter the "weld", away from a high stress area 118, which is the area connecting the flange and the inner or outer walls. One reason to avoid placing the weld on the high stress area 118 is because of the numerous problems which may arise during the welding process. For example, if the welding joint is not heated to the appropriate temperature or heated too much when welding, the resulting weld would be weak and therefore susceptible to break. Also, stress can accumulate when the weld is cooled too rapidly, causing the weld to crack. However, even when the welding is done properly, the location of the weld can cause the weld to experience thermal stress from the different temperature fluxes as fluid passes through the integrated flange joint, or stress due to deformation caused by external loads such as vibration from the machine to which the integrated flange joint is physically coupled. Therefore, forming the integrated flange joint such that the weld is not located on the flange but instead on the collar extending from the flange, lowers the risk of the weld experiencing excessive stress and therefore increases the fatigue life of the integrated flange joint.

Figure 4:
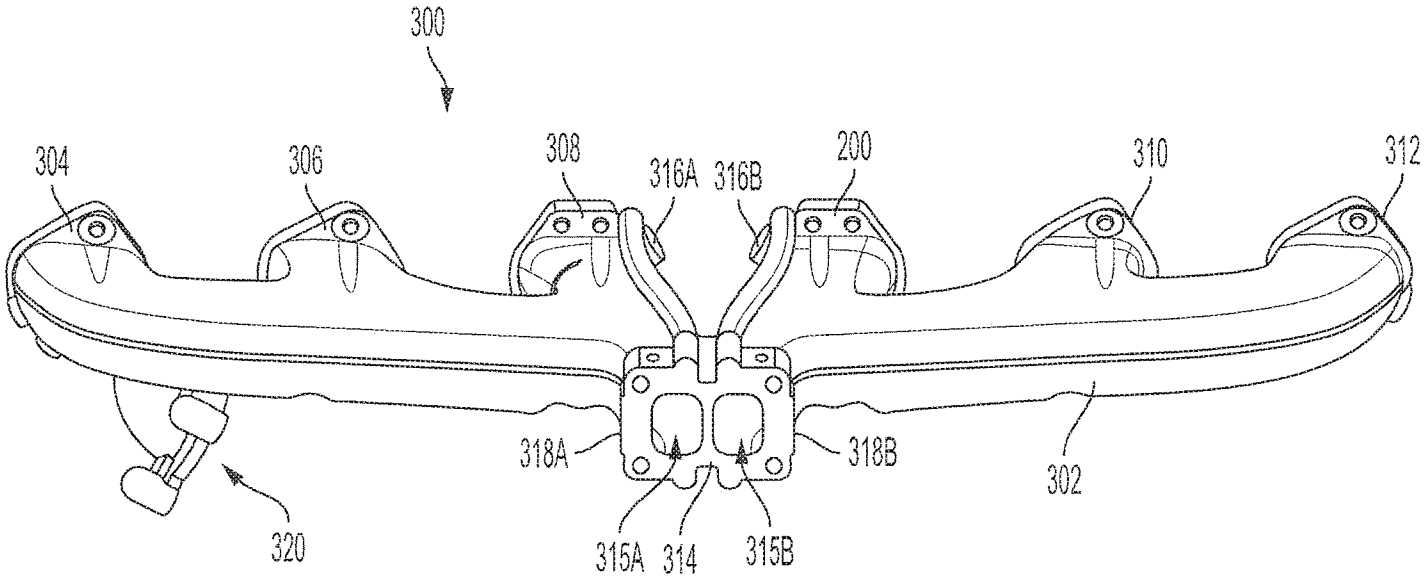
FIG. 4 is a front perspective view of one example of an assembled dual-wall airgap-insulated exhaust manifold using the dual-wall integrated flange joint of FIG. 3.
Figure 5:
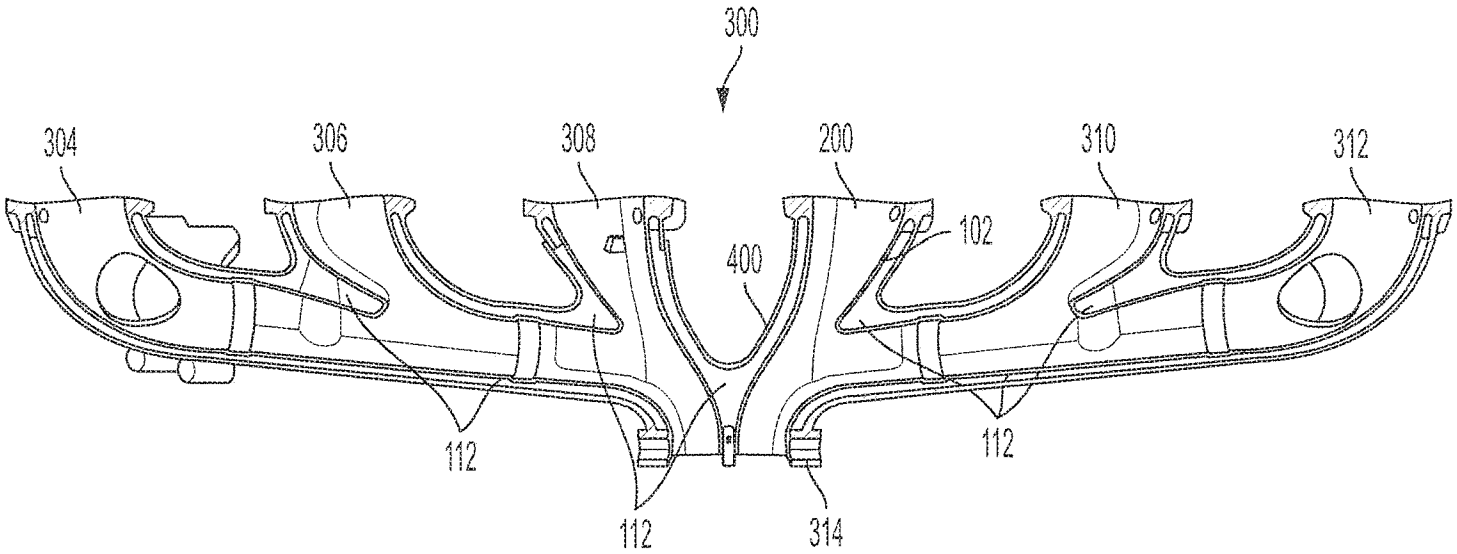
FIG. 5 is a cross-sectional view of the assembled dual-wall airgap-insulated exhaust manifold of FIG. 4.
Figure 6:
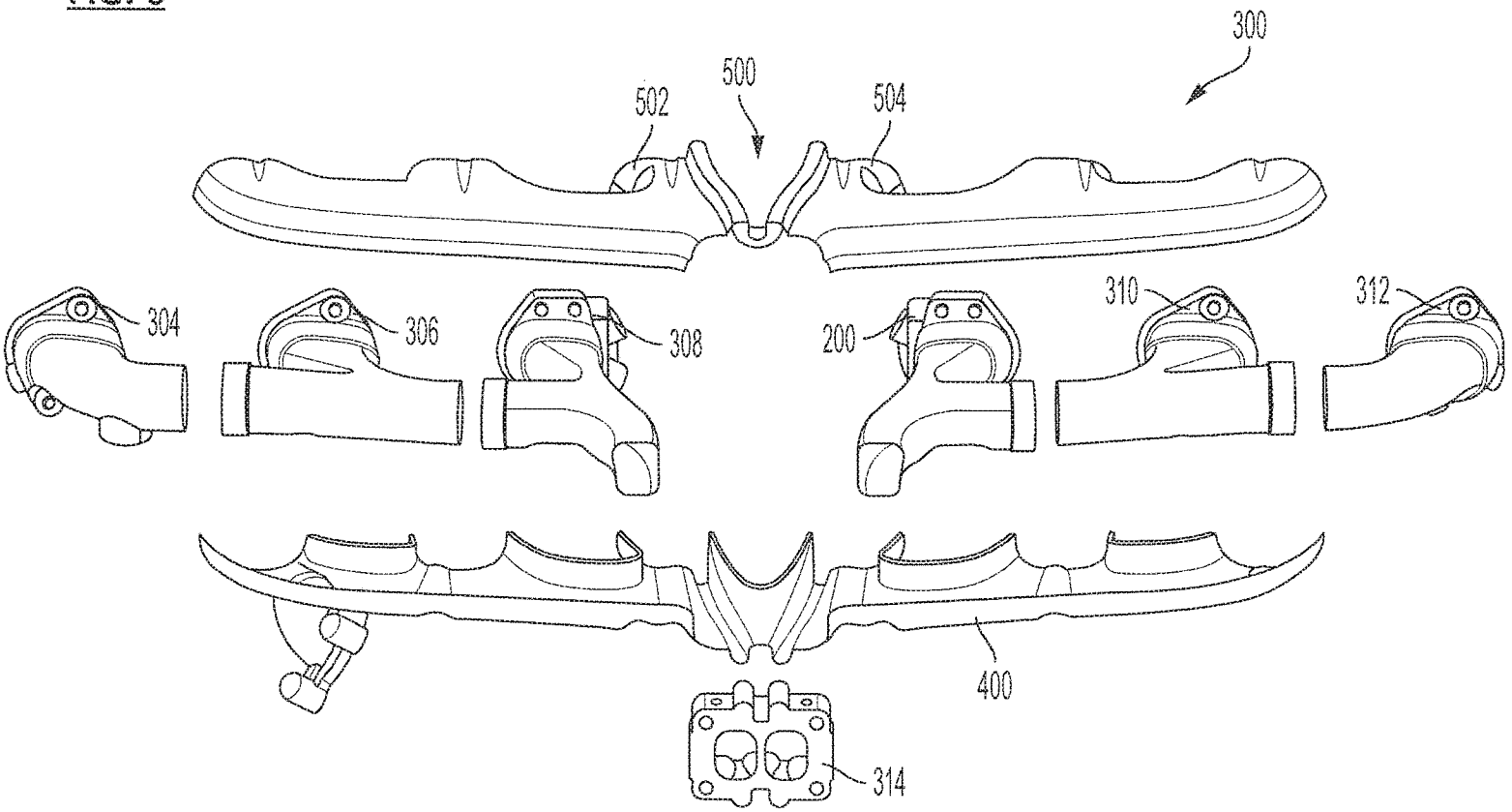
FIG. 6 is an exploded view of the dual-wall airgap-insulated exhaust manifold of FIG. 4.

FIGS. 4 to 6 illustrate an example of a dual-wall exhaust manifold 300 in a diesel engine as disclosed herein which uses the dual-wall integrated flange joint 200 among other integrated flange joints to attach the manifold to a cylinder head on one end and a turbocharger on the other end, such that exhaust gas flows through the inner wall 102 between the cylinder head and the turbocharger. In one example, the thickness of the airgap 112 ranges from 4 to 6 millimeters, the thickness of the inner wall 102 ranges from 1.5 to 2.5 millimeters, and the thickness of the outer shell ranges from 1.5 to 3 millimeters, although other suitable thicknesses and dimensions can be used in various implementations as appropriate. Another aspect of the disclosure includes the airgap 112 being airtight so as to prevent airflow once the exhaust manifold 300 is assembled. In another implementation, the airgap 112 contains suitable insulation materials such as knitted wire mesh, as appropriate.

The dual-wall exhaust manifold 300 includes an outer shell 302 welded to seven dual-wall integrated flange joints 200, 304, 306, 308, 310, 312, and 314, where all but the integrated flange joint 314 are coupled with a cylinder head (not depicted) when assembled, while the integrated flange joint 314 couples with a turbocharger (not depicted). The integrated flange joint 314 includes two inlets 315A and 315B such that the inlet 315A is fluidly coupled with the integrated flange joints 304, 306, and 308, while the inlet 315B is fluidly coupled with the integrated flange joints 200, 310, and 312. Each of the integrated flange joints is insertable into the outlet of at least one neighboring integrated flange joint using slip joint connections to form an interconnected inner wall assembly, which partially defines the airgap 112 of the exhaust manifold 300. Each of the integrated flange joints is connected to the outer shell 302 using lap joint connections. The integrated flange joints 308 and 200 have openings 316A and 316B, respectively, for coupling with exhaust manifold pressure (EMP) sensors, such that each EMP sensor measures the pressure level inside the corresponding integrated flange joint coupled therewith. Also, the integrated flange joint 314 includes two ports 318A and 318B on the sides to allow the inlets 315A and 315B, respectively, to couple with high speed data acquisition (HSDA) pressure transducers. Other possible sensors include a thermocouple that is coupled with each inlet to measure temperature within the inlet, but any suitable sensors and transducers can be coupled with the integrated flange joints, as appropriate. In addition, the exhaust manifold 300 includes a high pressure exhaust gas return (EGR) outlet 320 such that the exhaust gas from the integrated flange joint 304 does not enter the turbocharger but is instead directed to an EGR valve which diverts the exhaust gases away from the turbocharger and into an EGR loop back to the engines intake manifold for emission performance of the engine.

Figure 7:
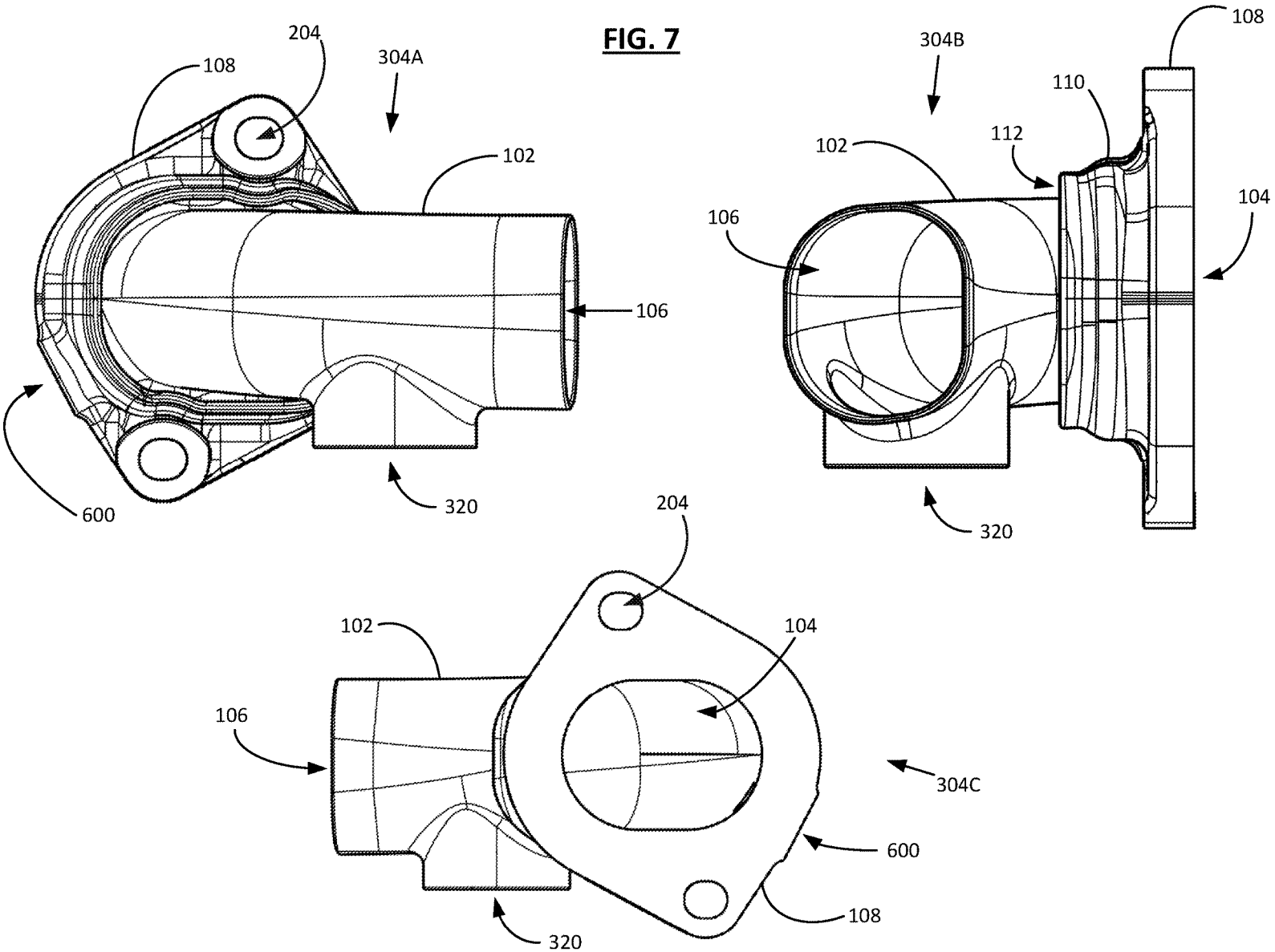
FIG. 7 illustrates three orthographic views of a dual-wall integrated flange joint used in the dual-wall airgap-insulated exhaust manifold of FIG. 4.
Figure 8:
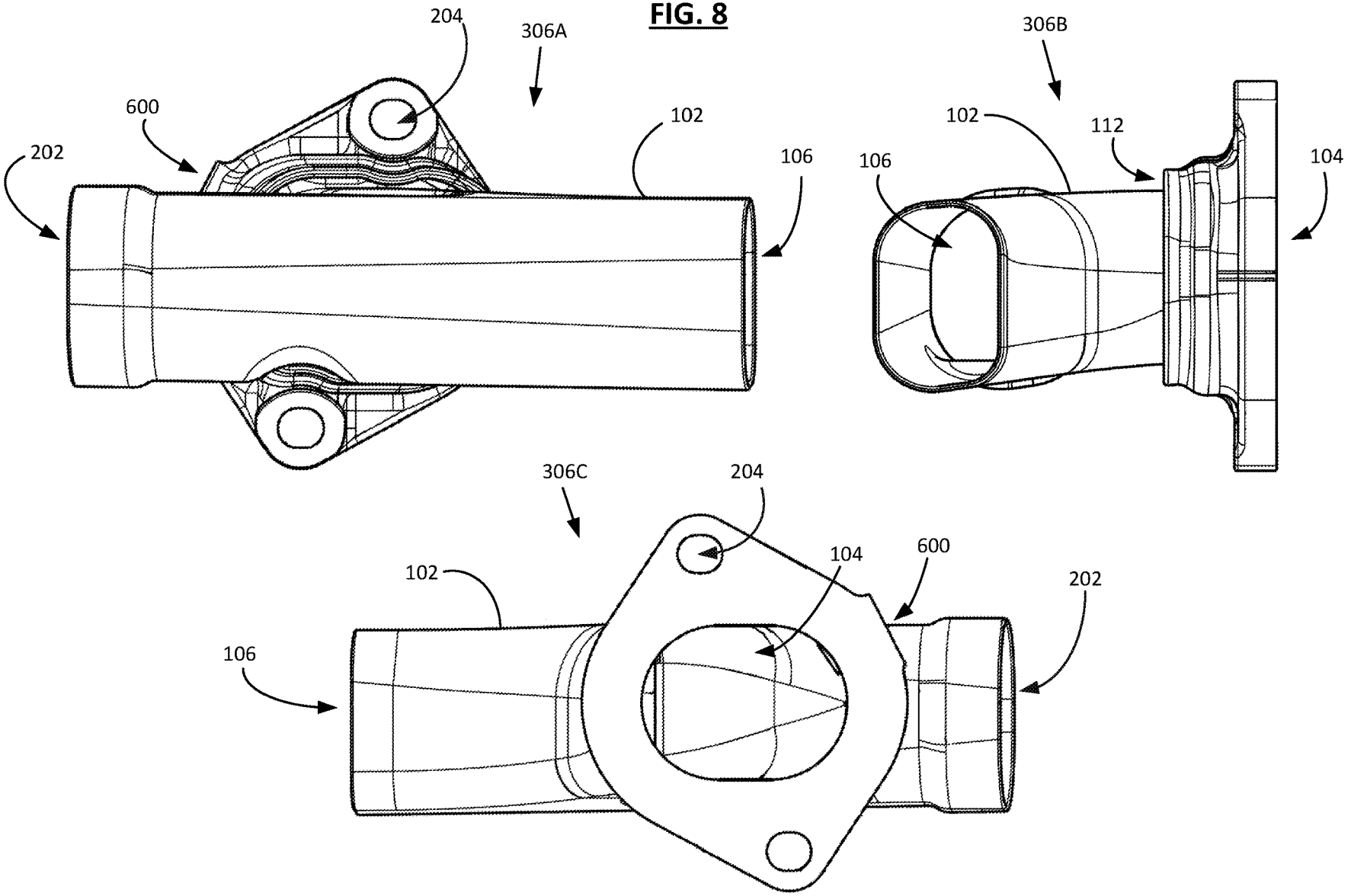
FIG. 8 illustrates three orthographic views of a dual-wall integrated flange joint used in the dual-wall airgap-insulated exhaust manifold of FIG. 4.
Figure 9:
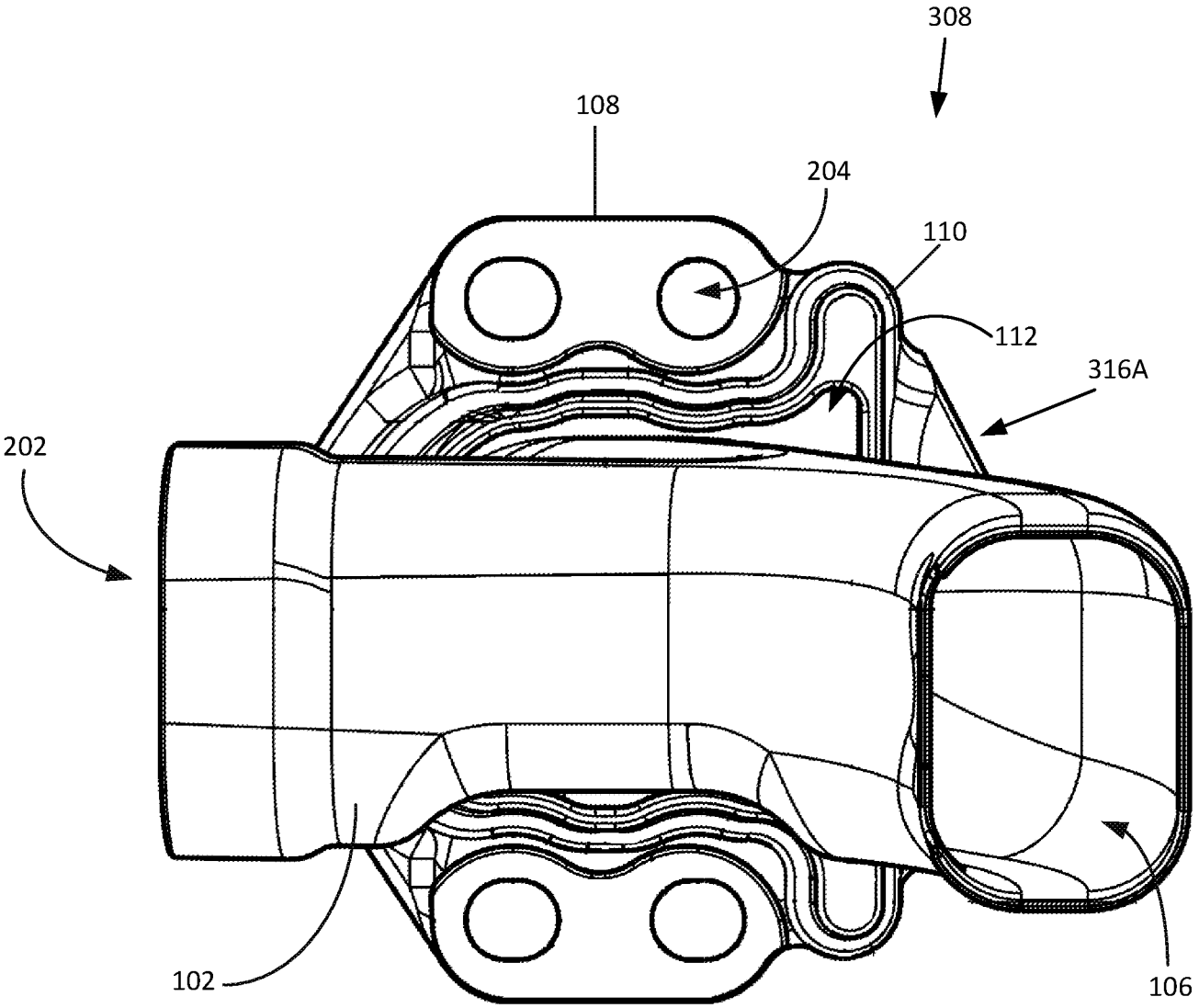
FIG. 9 is a bottom view of a dual-wall integrated flange joint used in the dual-wall airgap-insulated exhaust manifold of FIG. 4.
Figure 10:
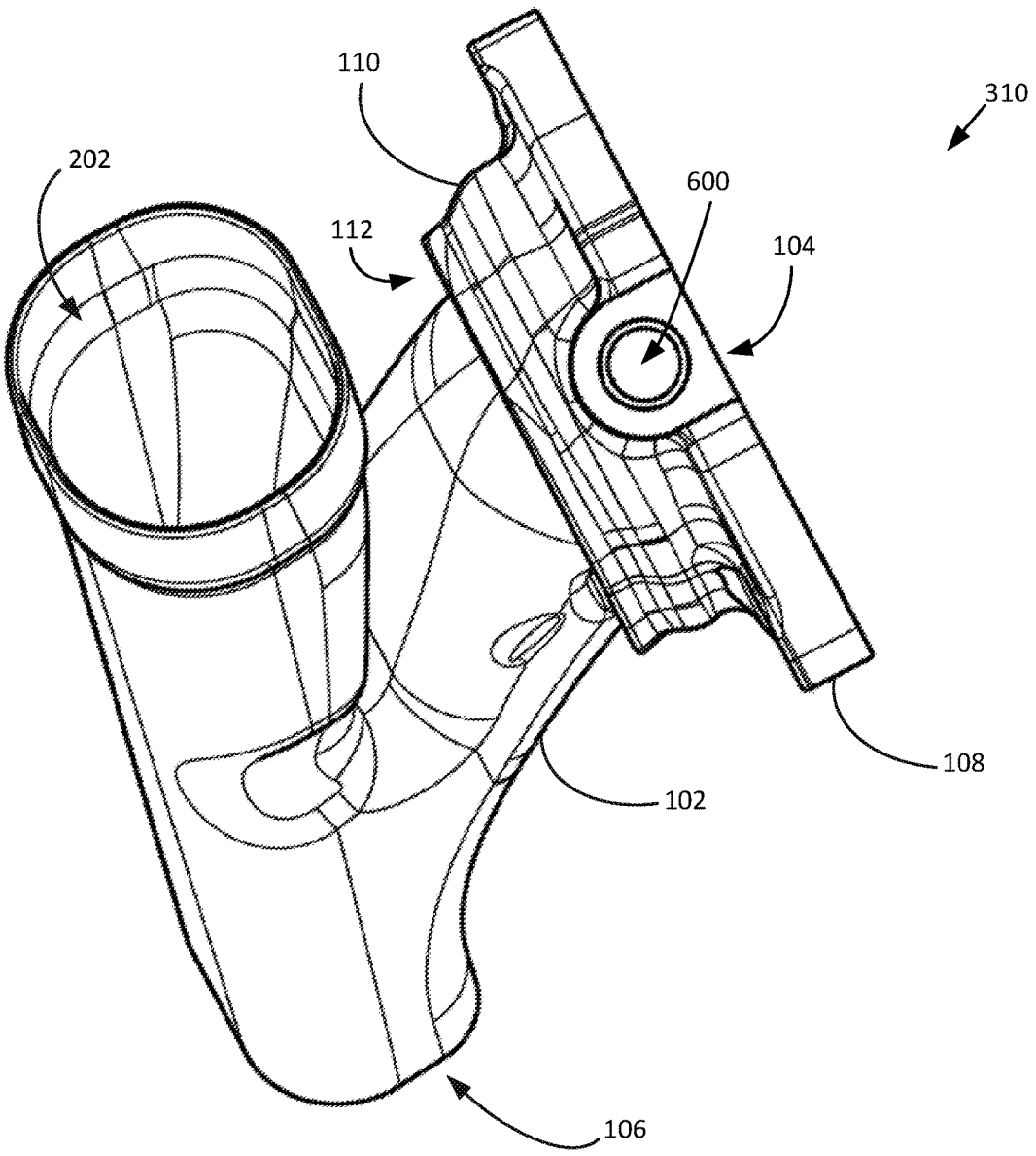
FIG. 10 is an auxiliary view of a dual-wall integrated flange joint used in the dual-wall airgap-insulated exhaust manifold of FIG. 4.
Figure 11:
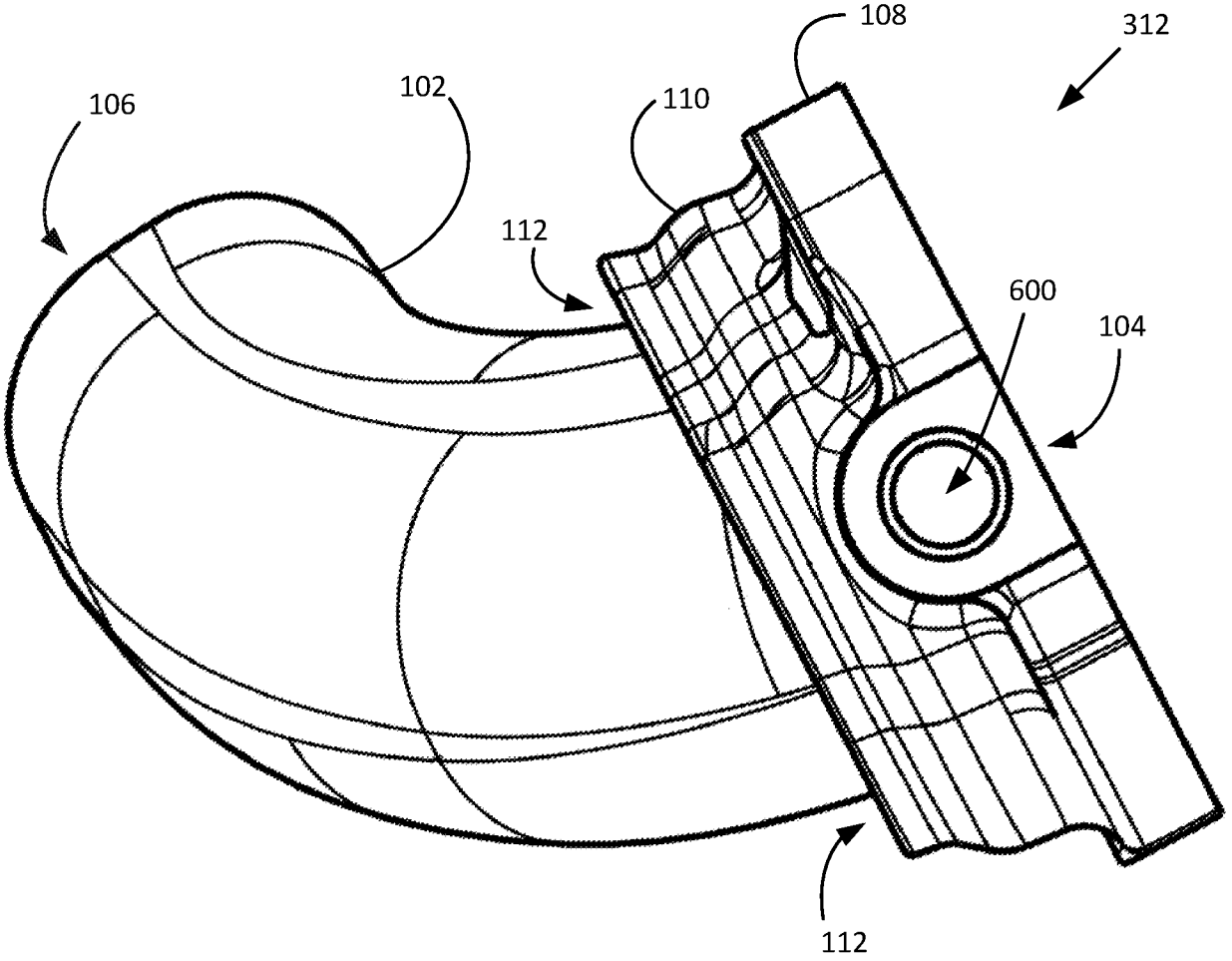
FIG. 11 is an auxiliary view of a dual-wall integrated flange joint used in the dual-wall airgap-insulated exhaust manifold of FIG. 4.
Figure 12:
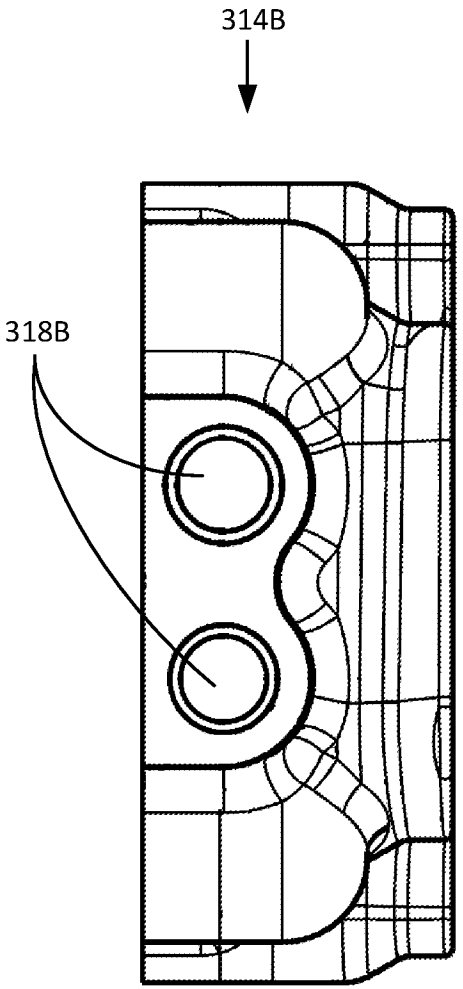
FIG. 12 illustrates two orthographic views of a dual-wall integrated flange joint used in the dual-wall airgap-insulated exhaust manifold of FIG. 4.
Figure 12:
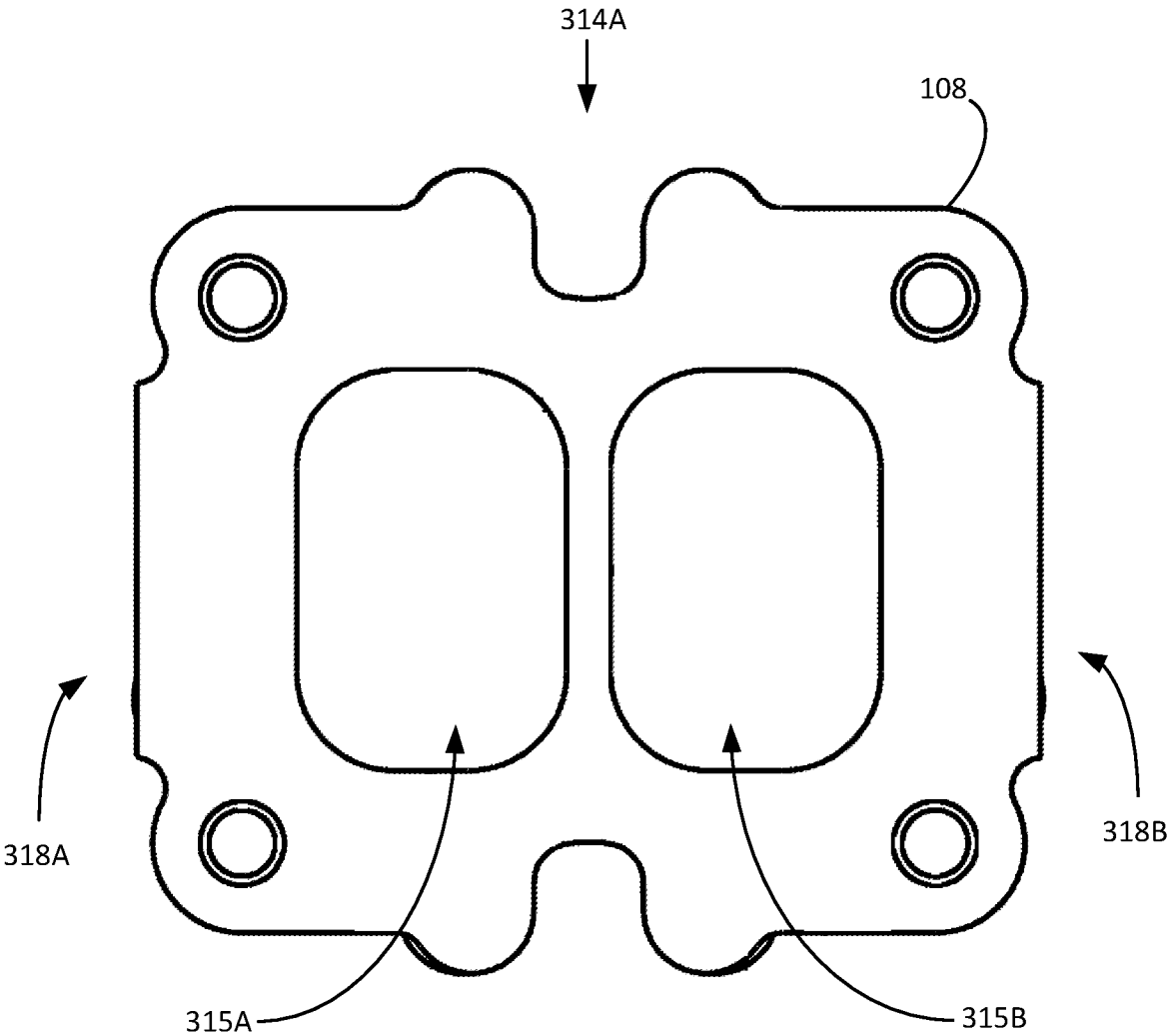

FIG. 7 shows three orthographic views 304A, 304B, and 304C of the integrated flange joint 304, where the second view 304B shows the first view 304A rotated 90 degrees to the left, and the third view 304C shows the second view 304B further rotated 90 degrees to the left. There is an opening 600 in each of the integrated flange joints 200, 304, 306, 308, 310, and 312 to couple a sensor such as a thermocouple, for example, with the inlet 104. FIG. 8 shows the integrated flange joint 306 from three different angles 306A, 306B, and 306C, with the second view 306B obtained by rotating the first view 306A 90 degrees to the left, and the third view 306C by rotating the second view 306B 90 degrees to the left. FIG. 9 shows the integrated flange joint 308 which is structurally similar to the integrated flange joint 200. FIG. 10 illustrates the integrated flange joint 310, and FIG. 11 illustrates the integrated flange joint 312. Similar to the integrated flange joint 200 in FIG. 3, each of the integrated flange joints 304, 306, 308, 310, and 312 includes an inner wall 102, an inlet 104, an outlet 106, a flange 108, and a collar 110 surrounding at least a portion of the inner wall 102. Each of the integrated flange joints 200, 306, 308, and 310 has a second outlet 202 which can also act as an inlet depending on the direction of the fluid flow within the manifold 300. The integrated flange joint 304 has an EGR outlet 320. FIG. 12 illustrates two orthographical views 314A and 314B of the integrated flange joint 314, where the first view 314A is a frontal view and the second view 314B is a side view obtained by rotating the first view 314A 90 degrees to the left.

In one implementation, the outer shell 302 of the exhaust manifold 300 is formed by welding together two components: a bottom shell 400 and a top shell 500. In another implementation, the top shell 500 is formed by combining two components: a left top shell portion 502 and a right top shell portion 504. The left top shell portion 502 and the right top shell portion 504 can be welded together or at least partially overlapped with one another to form the top shell 500. Other designs and implementations can include a number of suitable components different from the examples given above, as appropriate.

In another implementation, the integrated flange joint includes a separate runner component connected to the integrated flange joint such that the runner component functions as the inner wall instead of the integrated flange joint. The connecting of the integrated flange joint and the runner component is done by welding, for example, such that the weld is located away from the high stress area of the flange joint.

Advantages of a dual-wall exhaust manifold include enabling a more lightweight design, better engine transient performances, as well as added insulation between the inner and outer walls, such that the insulation prevents the outer wall from excessive heating, thereby reducing the risk of crack damages to the outer wall, and reducing the amount of heat released from the exhaust gas to the environment. The turbocharger receives high temperature exhaust gas from the cylinder head, and the drop in pressure and temperature of the gas across the turbocharger causes expansion of the exhaust gas to provide the energy to drive the compressor within the turbocharger. Therefore, the exhaust gas must retain as much as the heat as possible after leaving the cylinder head in order for the compressor to work efficiently, and reducing the amount of heat that escapes from the exhaust manifold into the environment increases the efficiency of the turbocharger. Furthermore, using the dual-wall integrated flange joints in the dual-wall exhaust manifold has additional advantages which include increasing the fatigue life of the manifold by locating the weld away from the high stress area, and minimizing heat transfer from the inner wall to the outer wall by preventing the outer wall from coming into contact with the inner wall.

Although the above embodiment discloses dual-wall exhaust manifolds, the dual-wall integrated flange joints can be implemented in other machines or systems that utilize dual-walls to create airgap insulation in between. One implementation uses the integrated flange joints in an aftertreatment system of a diesel engine, which treats post-combustion exhaust gases prior to emitting the gases through the tailpipe of the vehicle in order to mitigate exhaust pollution. For example, within the aftertreatment system, Selective Catalytic Reduction (SCR), Diesel Particulate Filter (DPF), and Diesel Oxidation Catalyst (DOC) technology can benefit from using the airgap insulation because it is desirable to keep as much of the heat inside the system as possible. Furthermore, the dual-wall integrated flange joints can also be implemented in exhaust pipes leading the exhausts gases from the engine to the outside environment.

The present subject matter may be embodied in other specific forms without departing from the scope of the present disclosure. The described embodiments are to be considered in all respects only as illustrative and not restrictive. Those skilled in the art will recognize that other implementations consistent with the disclosed embodiments are possible.

What is claimed is:

1. A dual-wall exhaust manifold comprising:

a plurality of dual-wall integrated flange joints each formed of a single piece of material and comprising an inner wall having at least one inlet and at least one outlet, a flange extending radially outward from the inlet of the inner wall, and a collar extending from the flange in the direction of the inner wall and surrounding at least a portion of the inner wall; and an outer shell configured to be welded to the collars of the plurality of dual-wall integrated flange joints to form a plurality of welds, wherein the welds are located away from high stress areas of the dual-wall integrated flange joints and a volume between the outer shell and the inner walls at least partially defines an airgap.

2. The dual-wall exhaust manifold of claim 1, further comprising an inner runner welded to the outlet of the inner wall in each of the plurality of dual-wall integrated flange joints, the inner runner at least partially defining the volume which defines the airgap.

3. The dual-wall exhaust manifold of claim 1, wherein the airgap forms an airtight insulation inside the exhaust manifold.

4. The dual-wall exhaust manifold of claim 1, wherein the outer shell comprises a top shell and a bottom shell, wherein the top and bottom shells are welded together to form the outer shell.

5. The dual-wall exhaust manifold of claim 4, wherein the top shell comprises a first shell component and a second shell component at least partially overlapped with the first shell component.

6. A dual-wall integrated flange joint comprising:

an inner wall having at least one inlet and at least one outlet, at least one of the inlet and the outlet comprising a plurality of openings;

a flange extending radially outward from the inlet of the inner wall; and a collar extending from the flange in the direction of the inner wall and surrounding at least a portion of the inner wall, wherein the dual-wall integrated flange joint is formed of a single piece of material, the collar at least partially defines an outer wall, and a volume between the collar and the inner wall at least partially defines an airgap of an airtight insulation.

7. The dual-wall integrated flange joint of claim 6, wherein the inner wall is configured to allow an inner runner to be welded to the outlet of the inner wall.

8. The dual-wall integrated flange joint of claim 6, wherein the collar is configured to allow an outer shell to be welded to the collar to form a weld, wherein the weld is located away from a high stress area of the dual-wall integrated flange joint.

9. The dual-wall integrated flange joint of claim 6, wherein the collar is configured to allow an outer shell to be welded to the collar to form a weld, wherein the weld is located away from a high stress area of the dual-wall integrated flange joint.

10. The dual-wall integrated flange joint of claim 9, wherein the outer wall is at least partially defined by the outer shell and the collar.

11. The dual-wall integrated flange joint of claim 6 wherein the collar extends perpendicularly from the flange.

12. The dual-wall integrated flange joint of claim 6 wherein the collar extends in a direction substantially parallel to the inner wall.

13. The dual-wall integrated flange joint of claim 6, wherein the inner wall is configured to allow an inner runner to be welded to the outlet of the inner wall.

14. The dual-wall integrated flange joint of claim 13, wherein the inner wall is slip fit into the inner runner.

15. A dual-wall integrated flange joint comprising:

an inner wall having a first portion defining at least one inlet and a second portion defining at least one outlet, the second portion being weldable to a first additional component;

a flange extending radially outward from the inlet of the inner wall; and a collar having a distal portion extending from the flange in the direction of the inner wall and surrounding at least a portion of the inner wall, the distal portion being weldable to a second additional component;

wherein the inner wall, the flange, and the collar of the dual-wall integrated flange joint are formed of a single unitary piece of material, the collar at least partially defines an outer wall, and the inner wall extends further than the collar in a direction from the at least one inlet to the at least one outlet, such that a volume between the collar and the inner wall at least partially defines an airgap, wherein the inner wall is configured to allow an inner runner to be welded to the outlet of the inner wall, and wherein the inner wall is slip fit into the inner runner.

16. The dual-wall integrated flange joint of claim 15, wherein at least one of the inlet and the outlet comprises a plurality of openings.

17. The dual-wall integrated flange joint of claim 15, wherein the inner wall comprises at least one opening coupled to at least one sensor.

18. The dual-wall integrated flange joint of claim 17, wherein the at least one sensor is configured to measure a temperature or a pressure inside the inner wall.

* * * * *